US005416684A

United States Patent [19]

Pearce

[11] Patent Number: 5,416,684

[45] Date of Patent: May 16, 1995

[54] LUMINAIRE HAVING PREDOMINANTLY REFRACTIVE DOWNLIGHT CAPABILITIES

[75] Inventor: J. Bradley Pearce, Hendersonville, N.C.

[73] Assignee: General Electric Company, Schenectady, N.Y.

[21] Appl. No.: 143,234

[22] Filed: Oct. 25, 1993

Related U.S. Application Data

[63] Continuation of Ser. No. 858,724, Mar. 27, 1992, abandoned.

[51] Int. Cl.[6] ..... F21V 5/02

[52] U.S. Cl. ..... 362/340; 362/337; 362/339; 362/329; 362/309; 362/310; 362/328; 362/363

[58] Field of Search ..... 362/336, 337, 339, 340, 362/338, 404, 329, 168, 309, 310, 318, 328, 329, 363

[56] References Cited

U.S. PATENT DOCUMENTS

| | | | |
|---|---|---|---|
| 538,193 | 4/1895 | Frédureau | 362/340 |
| 1,399,973 | 12/1921 | Limpert | 362/340 |
| 1,654,162 | 12/1927 | Doane | 362/307 |
| 2,831,394 | 4/1958 | Heenan et al. | 362/340 |
| 3,425,056 | 1/1969 | Dawson | 362/336 |
| 3,705,303 | 12/1972 | Willis, Jr. et al. | 362/337 |
| 4,371,916 | 2/1983 | De Martino | 362/340 |
| 4,816,976 | 3/1989 | Fouke et al. | 362/337 |
| 4,823,246 | 4/1989 | Dilouya | 362/336 |
| 4,839,781 | 6/1989 | Barnes et al. | 362/337 |
| 4,858,091 | 8/1989 | Fouke | 362/332 |

FOREIGN PATENT DOCUMENTS

| | | | |
|---|---|---|---|
| 322370 | 6/1989 | European Pat. Off. | 362/336 |

*Primary Examiner*—Ira S. Lazarus
*Assistant Examiner*—L. Heyman
*Attorney, Agent, or Firm*—George E. Hawranko; Stanley C. Corwin

[57] ABSTRACT

A luminaire capable of directing a high percentage of light source output in a downward direction includes a housing base, a light source mounted and electrically coupled to the housing base and a dome-shaped lens member made of light transmissive material disposed in surrounding relation to the light source. The lens member has a first region formed adjacent the housing base on which is disposed a first plurality of prismatic surfaces which both reflect and refract light in the downward direction. A second region is formed on the lens member adjacent the first region and includes a second plurality of prismatic surfaces which refract light output.

8 Claims, 3 Drawing Sheets

12
20
18
36
14
REGION "B"
REGION "A"
16
REGION "C"
10

LUMINAIRE HAVING PREDOMINANTLY REFRACTIVE DOWNLIGHT CAPABILITIES

This application is a continuation of application Ser. No. 07/858,724, filed Mar. 27, 1992, abandoned.

FIELD OF THE INVENTION

This invention relates to an electrical lighting fixture having a lens which is predominantly refractive and which exhibits improved downlight capabilities. More specifically, this invention relates to such an electrical lighting fixture, typically referred to as a luminaire, which provides the improved downlight capabilities by means of the lens which substantially surrounds the light source and is composed of a number of different types of prismatic surfaces that can selectively refract or refract and reflect the light being transmitted therethrough.

BACKGROUND OF THE INVENTION

In the field of industrial lighting, the aim of the lighting designer is to place as much light output from the lighting fixture in as precise a controlled area, or workplane, as possible. In performing this lighting design function, this operation of customizing the lighting direction includes optimizing the coefficient of utilization; that is, given that the coefficient of utilization is a ratio value indicative of the amount of light that can be directed to the workplane intended, it is most desirable to achieve the highest value coefficient of utilization. In attempting to achieve this optimum utilization of light from the lighting fixture, it is known to use a variety of light controlling lens members which can exhibit either reflective, refractive or a combination of refractive and reflective properties. An example of one reflector for use with a luminaire can be found in U.S. Pat. No. 3,457,399 issued to Milroy on Jul. 22, 1969. FIG. 7 of this reference illustrates an aluminum reflector for which it is known that approximately 20% of the lamp lumens is attenuated by the reflector.

An example of a specific lighting fixture designed to achieve a precisely controlled distribution of light to a particular work area can be found in U.S. Pat. No. 3,705,303 issued to Willis Jr. et al on Dec. 5, 1972 and assigned to the same assignee as the present invention. In this patent, the lighting fixture includes a conventional light source and ballast arrangement in combination with a cover member having a fluted upper reflector portion and an outwardly flared lower refractor portion. The luminaire in this patent, though effective for its intended purpose of controlling light output to a specific, low mounting application, is limited in that an aluminum reflector is used to reflect about 60% of the light output which is then directed through a lens member at the bottom end. Additionally, an aluminum reflector as discussed in this patent further suffers from the attenuation characteristics previously discussed.

Another example of a luminaire having specific light directing capabilities can be found in U.S. Pat. No. 4,118,763 issued to Osteen on Oct. 3, 1978 and assigned to the same assignee as the present invention. In this patent, the luminaire includes a globe member disposed about the light source and which is constructed of a light transmissive material having a number of different prismatic surfaces which are effective in combination with the shape and mounting of the cover, such that the light is output in various directions including the upward direction. The application of the embodiments of this patent is one in which it is desired to provide a significant amount of uplighting and accordingly, this patent relies primarily on the reflective properties of the prismatic surfaces formed on the cover member.

In an industrial application such as the lighting of a warehouse or manufacturing floor having equipment which extends upward a significant distance from the actual floor or equipment height level, it is desirable to control the light output such that a downward directed light output is achieved using a predominantly refractive light transmissive cover which allows light output to be directed in a substantially sideways direction in addition to the downward direction. Another example of a luminaire having specific light directing capabilities is a product marketed as a Vertiflex Industrial luminaire provided by the Crouse-Hinds Division of Cooper Lighting which has a place of business in Vicksburg, Miss. This luminaire utilizes a predominantly refractive fixture which results in a very wide beam lighting distribution having significant uplighting characteristics. Though exhibiting a high efficiency, the Super Watt luminaire exhibits poor lumen utilization since most of the lamp lumens are directed at high angles.

Accordingly, it would be desirable to provide a lighting fixture which achieved sufficient illumination at heights typically found in an industrial or warehouse environment and whereby such illumination was achieved using refractive elements that could direct a substantial portion of the light output in a downward direction having an angle of dispersion less than 60 degrees relative to the nadir when measured near the luminaire. It would be further advantageous if the light source would be disposed relative to the lens member in a manner to maximize the amount of available lamp lumens for the necessary controlled illumination. It would also be advantageous if, in addition to the applicability to a high bay configuration, this luminaire could be utilized in a low bay type of environment without modification to the luminaire.

SUMMARY OF THE INVENTION

The present invention provides a luminaire having a predominantly refractive lens member with a combination of refractive and reflective surfaces arranged so that the luminaire achieves improved coefficient of utilization at lower spacing criteria characteristics relative to a luminaire which utilizes a standard refractive covering. Moreover, the luminaire and refractive lens member of the present invention allows for increased luminaire efficacy by refractively redirecting high angle lamp light into a useful downward beam; that is, the luminaire and refractor assembly of the present invention redirects a large percentage of the light output of the lamp in a useful downward direction defined by a cone of less than 60 degrees as measured from the nadir. It is known in the industry that typical photometric properties of a luminaire are measured in candela units from 0 degrees to 180 degrees beginning at the nadir and wherein such measurement is taken at a distance of 25 feet from the luminaire.

In accordance with the principles of the present invention, there is provided a luminaire having a housing base with electrical connections thereto for energizing the light source which is mounted on the housing base. A reflector arrangement is disposed near the housing base to direct light downward and away from the housing base. A lens member disposed in surrounding relation to a substantial portion of the light source, is constructed of an essentially light transmissive material and is connected to the housing base along its bottom perimeter. In order to efficiently redirect high angle light from the light source to a useful area defined by cone of less than 60 degrees measured from the nadir, the cover member has a first region near the housing base on which is disposed a first plurality of prismatic surfaces capable of reflecting and refracting light from the light source, a second region adjacent the first region having a second plurality of prismatic surfaces disposed thereon which are effective for refracting light output from the light source and a third region adjacent the second region which has a substantially smooth surface without prismatic surfaces disposed thereon.

BRIEF DESCRIPTION OF THE DRAWINGS

In the following detailed description of the invention, reference will be made to the attached drawings in which.

DETAILED DESCRIPTION OF THE INVENTION

Figure 1:
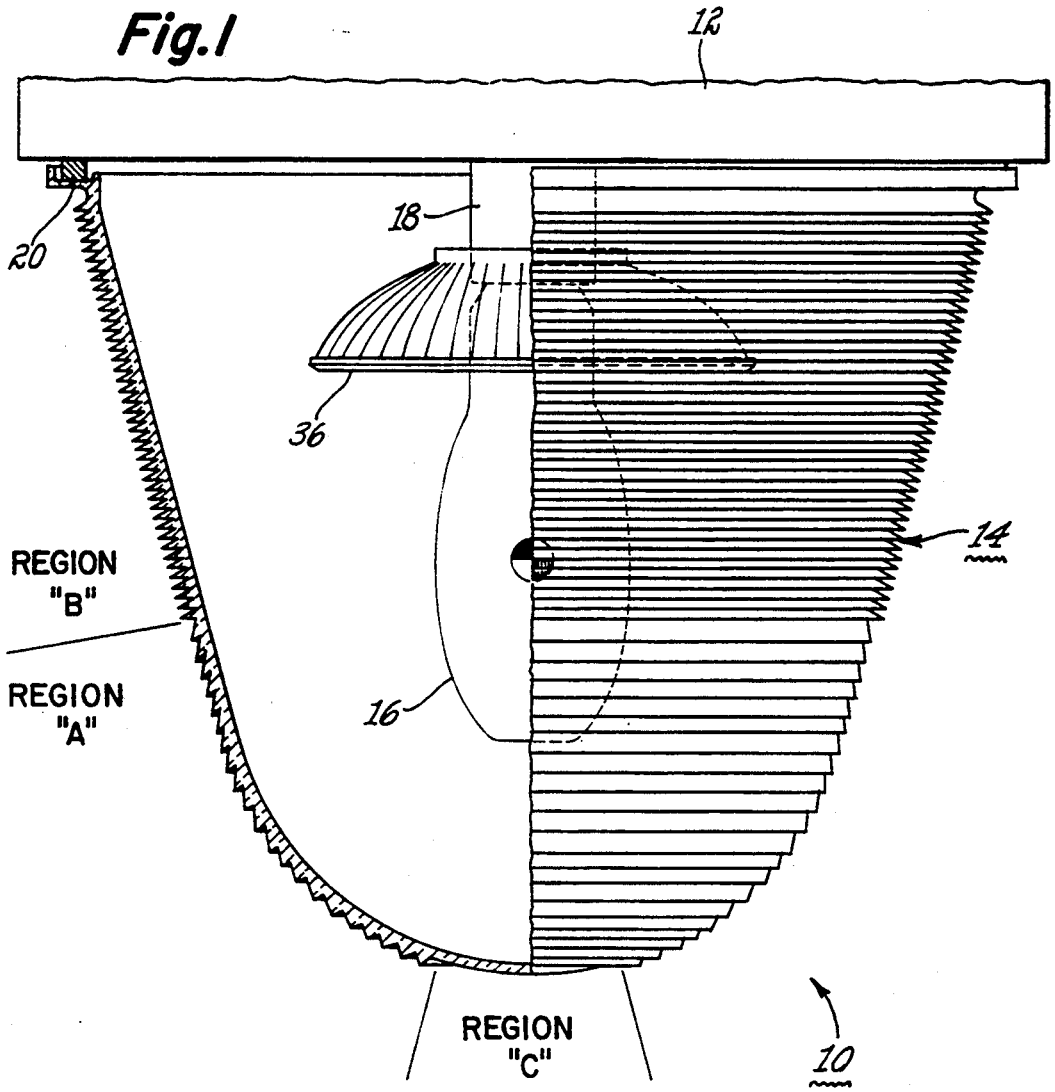
FIG. 1 is an elevational view in section of a luminaire and refractive covering constructed in accordance with the present invention.

As seen in FIG. 1, the luminaire 10 of the present invention includes a housing or base portion 12 which is illustrated mainly as a plate shaped member but which in fact can be provided by means of various configurations which would be mountable to factory or building ceiling in a conventional manner and which could also accommodate the mounting of a lens member 14 thereto. The lens member 14 is constructed of a light transmissive material such as an acrylic material or glass and is formed in a generally dome shaped manner. Of course, it can be understood that the lens member 14 can be constructed of other light transmissive materials and can be shaped differently than the dome and by use of the surrounding relation to the light source and the combination of prismatic surfaces as will be discussed later in further detail, still practice the principles of the present invention. A light source 16, typically a gaseous discharge type, is disposed within the lens member 14 and is electrically coupled via a conventional lamp socket 18 disposed on the housing base 12. A reflector plate 36 is mounted near the lamp socket 18 above light source 16 so as to direct light output downward and away from housing base 12. A ballast arrangement (not shown) is typically mounted within the housing base 12 for the purpose of conditioning the input current so as to more efficiently energize the light source 16.

The cover member 14 can have an extending lip portion 20 formed along at least a portion of the periphery thereof so that the cover member 14 can be securely fastened to the housing base 12. Formed along a first region of the cover member 14, identified as region A in FIG. 1, is a plurality of prismatic surfaces 22 which extend around the circumference of the cover member 14 at the portion closest to the housing base 12. The prismatic surfaces 22 of region A, the details of which will be described in relation to FIGS. 2 and 4, extend down the cover member 14 to a point just beyond the center of the light source 16. Since prismatic surfaces 22 surround the entire portion of the light source 16 closest to the housing base 12, it can be appreciated that prismatic surfaces 22 are effective for efficiently directing the light output of the light source 16 that would otherwise be output at high angles and therefore contribute little to the illumination of the factory or warehouse setting, in a useful downward direction. First prismatic surfaces 22 will include both reflective and refractive surfaces as will be discussed later, and will differ from the typical reflector member used for luminaires in which an aluminum or prismatic reflector is utilized to direct light output in a downward direction. It is known that such a purely reflective aluminum cover can result in a substantial loss of luminaire efficiency. Typically, the losses associated with a finished aluminum reflector are on the order of approximately 20% of the light is controlling. Furthermore, typical covers which are predominantly refractive can suffer from a wide Spacing Criteria characteristic (typically in excess of 2.0) and can also suffer from poor light utilization. This is due to the fact that bare lamp light above an 80 degree cone (measured from the nadir), is difficult to redirect to a useful downward direction (defined as within a 60 degree cone as measured from the nadir). The Spacing Criteria measure is important to the lighting designer in that such a measure provides for evaluating the performance of the luminaire and specifically indicates the spread of the light output, whether wide or concentrated thereby determining the number of fixtures needed to illuminate a specified area. The design of the present invention allows for an improved coefficient of utilization at lower spacing criteria relative to a typical refractive luminaire and offers improved luminaire efficacy in the 15–30 foot mounting height range resulting in the need for fewer fixtures to perform a given lighting task.

A second plurality of prismatic surfaces 24 are disposed around the portion of the lens member 14 adjacent to prismatic surfaces 22 disposed in region A and are indicated as occupying region B in FIG. 1. The second plurality of prismatic surfaces 24 are disposed around the lower portion of the light source 16 as seen in FIG. 1 and extend down toward the lowest portion of the lens member 14. At the lowest point of the lens member 14, a third region, region C, can be provided in which the light output is neither refracted of reflected, the light output exiting the lowest portion of the lens member 14 is thereby allowed to exit straight downward.

Figure 2:
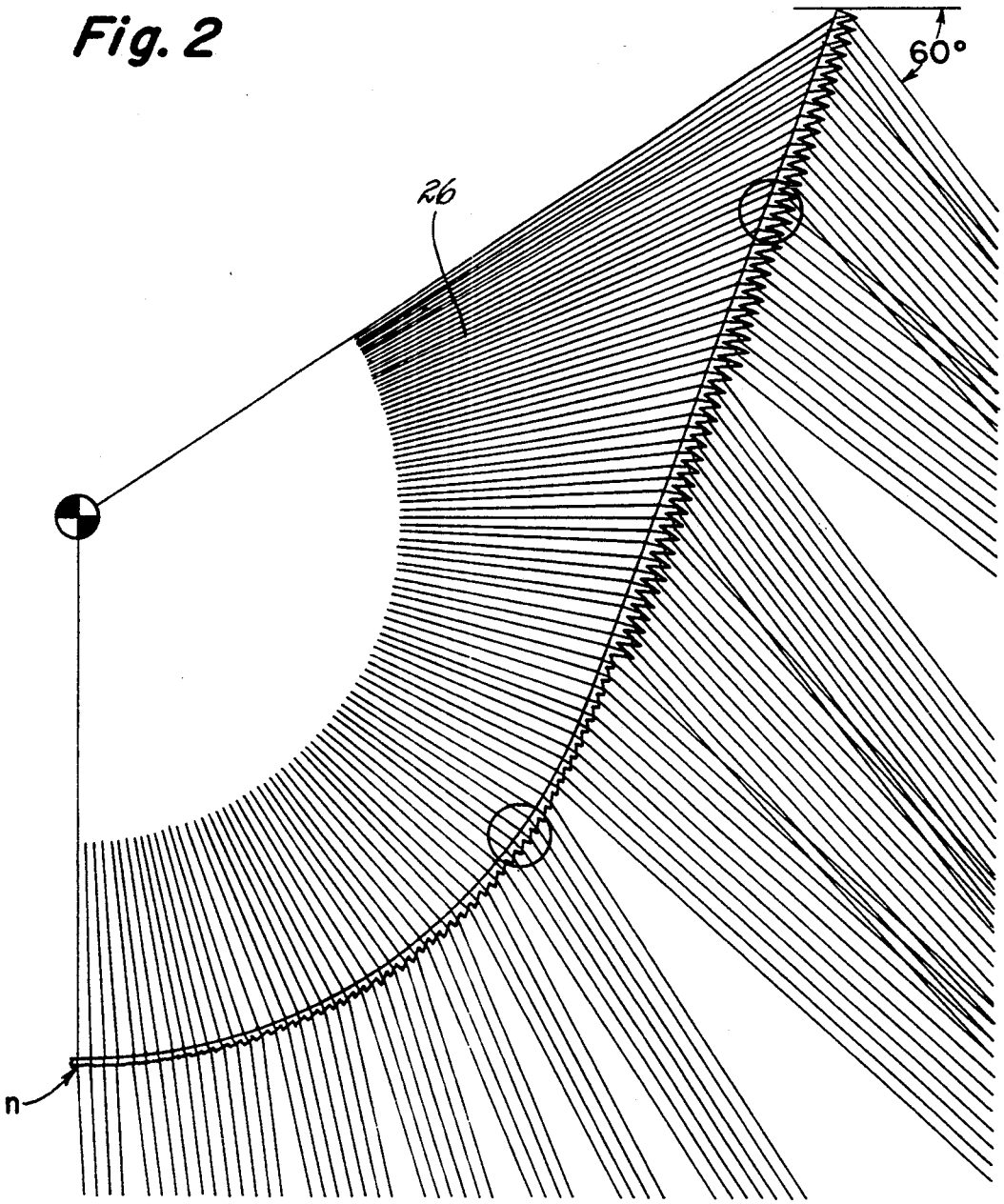
FIG. 2 is an elevational view of a portion of the refractor member of the present invention in which the refractive and reflective properties of the cover member are illustrated.

The performance of the first and second pluralities of prismatic surfaces in terms of affecting the light output of the light source 16 can be seen in FIG. 2. The light output from the lamp is illustrated in FIG. 2 by the plurality of rays 26 emanating from the center point representation of the light source 16 and which for the purposes of the present invention, occupy the space defined between the nadir, designated n, and the ray which is located at a point approximately 127 degrees from the nadir n. The plurality of light rays 26 illustrated in FIG. 2, together with the mirror image rays (not shown) which comprise the left side of the light source, cover member configuration, represent approximately 90% of the light output of the light source 16. It can be further seen from FIG. 2 that the light rays reflected and refracted by the first plurality of prismatic surfaces 22 will be output at various downward directed angles due to the fact that such rays enter the uniformly constructed prismatic surfaces 22 at different angles. In fact, the directed light rays, that is, the light rays 26 which have passed through the plurality of prismatic surfaces 22, overlap at portions as a result of the entrance of the various light rays 26 at different angles and the uniformity of the reflective and refractive surfaces (see FIG. 4) of the plurality of prismatic surfaces 22. The effect of this crossover feature at angles greater than 60 degrees relative to the nadir is negligible when measured according to conventional practices for determining light distribution properties for luminaires. Specifically, typical photometric curves for luminaires are measured in terms of candela units at a distance of 25 feet from the luminaire and at such distance, the amount of light spilling into a region greater than 60 degrees relative to the nadir, is negligible. This crossover feature of light rays 26 emerging from the first plurality of prismatic surfaces is necessary to make full use of the available light output of the light source 16. The uppermost light ray is directed downward so that a 30 degree angle is formed between the horizontal surface of the luminaire 10 and the first downward directed light ray. Light rays 26 which enter the second plurality of prismatic surfaces 24 are also directed downward but are directed in a manner so that light rays 26 emerging from the second plurality of prismatic surfaces 24, do not intersect one another but only intersect a portion of the light rays emerging from the lowest ones of the first plurality of prismatic surfaces 22 which are adjacent the second plurality of prismatic surfaces 24.

Figure 3:
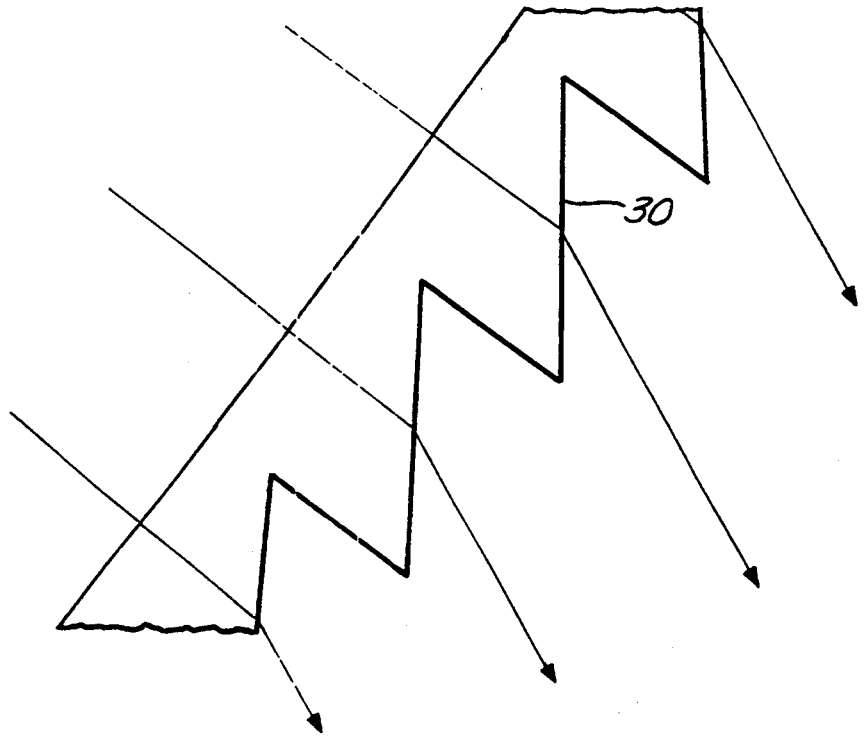
FIG. 3 is an elevational view in section of the refractive types of prismatic surfaces disposed on the cover member of the present invention.
Figure 4:
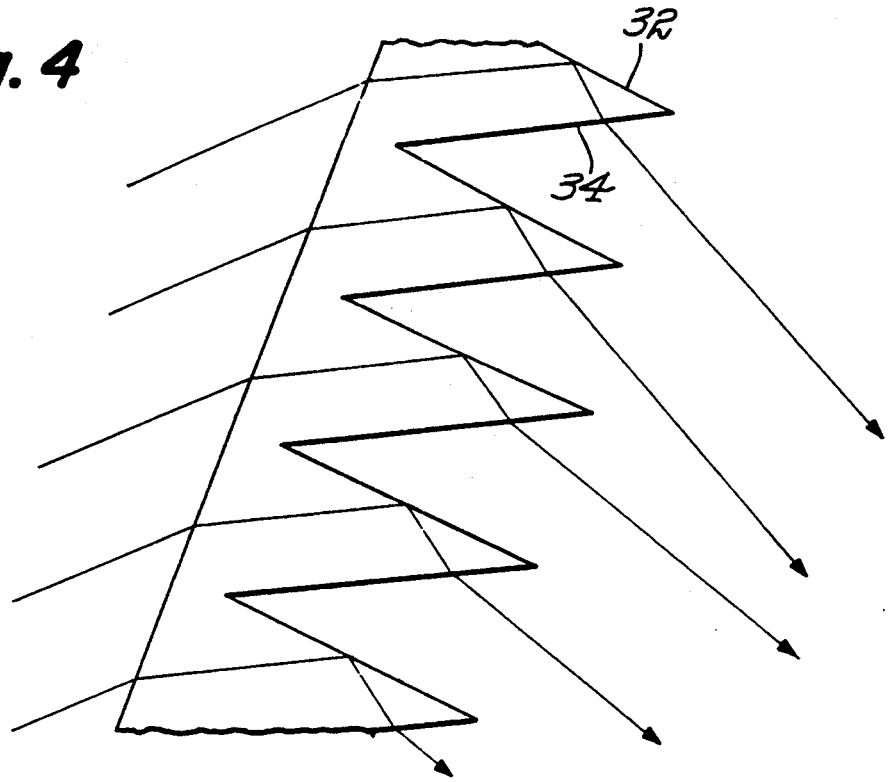
FIG. 4 is an elevational view in section of the reflective types of prismatic surfaces disposed on the cover member of the present invention.

The surfaces of each of the first and second pluralities of prismatic surfaces 22, 24 are illustrated in FIGS. 3 and 4 wherein FIG. 3 illustrates the second plurality of prismatic surfaces 24 which are refractive in nature whereas FIG. 4 illustrates the first plurality of prismatic surfaces 22. The first prismatic surfaces 22 are both reflective and refractive in order to provide the necessary redirection of the light rays 26 in the downward direction which in some instances, must account for a 90 degree downward deflection of the light ray. As seen in FIG. 3, the second prismatic surfaces 24 include a refractive surface 30 which refracts the light ray 26 a predetermined amount, this type of prism can be used in regions where only modest redirection of the light ray is desired. In FIG. 4, it can be seen that the first prismatic surfaces 22 include a first reflective surface 32, and a second refractive surface 34.

Although the hereinabove described embodiment of the invention constitutes the preferred embodiment, it can be appreciated that modifications can be made thereto without departing from the scope of the invention as set forth in the appended claims. For instance, although the cover member 14 is described as being constructed of an acrylic plastic which is effective for keeping transmission losses below approximately 1%, it is possible to use another material and achieve the downward directing properties of the present invention but not with equal efficiency of transmission, temperature withstand capability and resistance to ultraviolet light degradation. Additionally, it is possible to modify the first prismatic surfaces so that the downward direction of the light output is between 60 and 70 degrees relative to the nadir of the luminaire, such range being achievable by practicing the teachings of the present invention.

I claim:

1. An electric lighting fixture comprising:

a housing base having an electrical connection for receiving electrical energy thereby;

a light source disposed on said housing base and being coupled to said electrical connection so that said light source can be energized thereby;

a reflector member disposed between said housing base and said light source and effective such that light output from said light source directed toward said housing base is reflected away from said housing base;

a lens member disposed in surrounding relation to a substantial portion of said light source, said lens member being connected to said housing base;

wherein said lens member is constructed of essentially a light transmissive material and is dome-shaped having a side portion adjacent said housing base which is oriented in an inwardly sloping direction relative to said housing base;

wherein said lens member has disposed on a first region nearest said connection to said housing base, a first plurality of prismatic surfaces capable of reflecting and refracting light output from said light source which strikes said first region, and further wherein said lens member has formed on a second region adjacent said first region, a second plurality of prismatic surfaces which serve to predominantly refract light output from said light source which strikes said second region and wherein said first plurality of prismatic surfaces are divided into zones of uniform prismatic surfaces such that light output directed through each of said zones crosses over in a predetermined manner light output directed through an adjacent zone.

2. An electric lighting fixture as set forth in claim 1 further comprising a third region formed on said lens member adjacent said second region, said third region being formed so that light output from said light source which strikes said third region is transmitted therethrough in an essentially non-refracted and non-reflected manner.

3. An electric lighting fixture as set forth in claim 2 wherein said first region of said lens member is larger in area than either of said second and third regions of said lens member.

4. An electrical lighting fixture comprising:

a housing base having an electrical connection provided thereto;

a light source disposed on said housing base and being connected to said electrical connection such that said light source is energized thereby;

a reflector member disposed between said housing base and said light source and being effective such that light output from said light source directed toward said housing base is reflected away from said housing base;

a lens member disposed in surrounding relation to said light source and being secured to said housing base, said lens member being constructed of a light transmissive material and being essentially dome-shaped such that an opening is formed at the base portion of said lens member, said opening having a flange portion formed thereon so as to be secured to said housing base; and wherein said lens member has a first region formed near said opening, said first region having formed thereon, a first plurality of prismatic surfaces having both reflective and refractive surfaces and being effective such that substantially all light output from said light source which strikes said lens member is directed at an angle of less than 60 degrees relative to the nadir of said electrical lighting fixture, said lens member having a second region formed adjacent said first region, said second region having formed thereon, a second plurality of prismatic surfaces having predominantly refractive surfaces.

5. The electrical lighting fixture of claim 4 further comprising a third region formed adjacent said second region and occupying a bottom space associated with said dome-shaped lens member, said third region being formed of said light transmissive material without prismatic surfaces disposed thereon.

6. The electrical lighting fixture of claim 4 wherein said first plurality of prismatic surfaces are formed around the circumference of said lens member and are all formed in the substantially same manner such that light output from said light source which strikes said first region at different angles is directed through said first plurality of prismatic surfaces in a manner so as to cross over one another at predetermined light output zones.

7. An electrical lighting fixture comprising:

a housing base having an electrical connection provided thereto;

a light source disposed on said housing base and being connected to said electrical connection such that said light source is energized thereby;

a reflector member disposed between said housing base and said light source and being effective such that light output from said light source directed toward said housing base is reflected away from said housing base; and a predominantly transmissive lens member disposed in surrounding relation to said light source and having a first plurality of prismatic surfaces with both reflective and refractive surfaces and a second plurality of prismatic surfaces with predominantly refractive surfaces, said lens member being constructed of non-metallic material and being effective such that at least 70% of the light source output is controlled by said prismatic surfaces so as to be redirected into an effective lighting zone defined as a 120 degree cone centered around nadir.

8. The electrical lighting fixture of claim 7 wherein said first plurality of prismatic surfaces are divided into zones of uniform prismatic surfaces formed such that light output directed through each of said zones crosses over in a predetermined manner light output directed through an adjacent zone.

* * * * *